US008347447B2

(12) United States Patent
Benson et al.

(10) Patent No.: US 8,347,447 B2
(45) Date of Patent: Jan. 8, 2013

(54) MOP BODY HAVING RECESSED SIDE SURFACES

(75) Inventors: Shaelyn D. Benson, St. Paul, MN (US); Sean C. McGreevy, St. Paul, MN (US); Lloyd S. Vasilakes, Stillwater, MN (US); Ivana Babic, Milan (IT)

(73) Assignee: 3M Innovative Properties Company, Saint Paul, MN (US)

( * ) Notice: Subject to any disclaimer, the term of this patent is extended or adjusted under 35 U.S.C. 154(b) by 593 days.

(21) Appl. No.: 12/615,464

(22) Filed: Nov. 10, 2009

(65) Prior Publication Data

US 2011/0107537 A1 May 12, 2011

(51) Int. Cl.
*A47L 13/20* (2006.01)

(52) U.S. Cl. ..... 15/228; 15/244.1; 15/209.1

(58) Field of Classification Search ..... 15/228, 15/231, 209.1, 210.1, 244.1, 244.2, 244.3
See application file for complete search history.

(56) References Cited

U.S. PATENT DOCUMENTS

| | | | | |
|---|---|---|---|---|
| 2,138,288 | A | 11/1938 | Bailey | |
| 5,477,582 | A * | 12/1995 | Yamashita | 15/231 |
| 6,813,800 | B2 | 11/2004 | Liccardi | |
| 7,111,353 | B2 * | 9/2006 | Cowdery | 15/209.1 |
| 7,958,592 | B2 * | 6/2011 | Nobile et al. | 15/228 |
| 2003/0171051 | A1 | 9/2003 | Bergsten et al. | |
| 2007/0107156 | A1 | 5/2007 | Willman et al. | |
| 2007/0136967 | A1 | 6/2007 | Tochacek et al. | |
| 2007/0202768 | A1 | 8/2007 | Haskett et al. | |
| 2007/0220693 | A1 * | 9/2007 | Billig et al. | 15/104.94 |
| 2010/0044909 | A1 | 2/2010 | Haskett et al. | |

FOREIGN PATENT DOCUMENTS

| | | |
|---|---|---|
| EP | 0 370 697 A1 | 5/1990 |

* cited by examiner

*Primary Examiner* — Shay Karls
(74) *Attorney, Agent, or Firm* — Trisha D. Adamson

(57) ABSTRACT

Disclosed is a mop body that includes side surfaces that are substantially recessed from a lowermost contact point. The greatly recessed side surfaces completely remove a large portion of the cleaning surface from contact with the surface to be cleaned. Upon rotation of the mop body, the side surfaces can be placed into contact with the surface to be cleaned in order to pickup dirt, hair, lint, or other debris captured by the portion of the mop body contacting the surface to be cleaned. Further, in some embodiments the lowermost contact provides essentially a single point of contact with the surface to be cleaned to enable the mop body to easily remove debris from corners. The disclosed mop construction greatly enhances the total amount of surface area that can be effectively used for cleaning.

14 Claims, 4 Drawing Sheets

MOP BODY HAVING RECESSED SIDE SURFACES

BACKGROUND

The present disclosure relates to a mop body. In particular, the present disclosure relates to a mop body having recessed side surfaces.

Mops are routinely used to clean floors. Typically, flat mops have a generally rectangular and planar working surface. Floor mops can be used wet by either having a sponge or a wet cleaning sheet applied over the mop body. Floor mops can be used dry by applying a dry cleaning sheet over the mop body. Typically, because flat mops have a planar working surface, only the leading edge or trailing edge of the working surface of the mop is effectively used to clean the floor. Therefore, large portions of the cleaning sheet are essentially unused for picking up dirt, hair, lint, or other debris.

Efforts have been made to modify either the construction of the mop or the construction of the cleaning sheet to improve the amount of surface area of the cleaning sheet that is used for picking up dirt and other debris. Cleaning sheets may include various amounts of topography or spacers to remove portions of the cleaning sheet while maintaining contact with the surface to be cleaned at other portions of the cleaning sheet. US Patent Application Publication 2007/0107156 discloses a variety of embodiment of cleaning implements that comprise a gap at the leading edge and trailing edge. However, the gap is only slightly recessed from the working surface causing essentially all of the cleaning cloth to come into contact with the surface to be cleaned with only slight actuation of the mop.

SUMMARY

Disclosed is a mop body that includes side surfaces that are substantially recessed from a lowermost contact point. The greatly recessed side surfaces completely remove a large portion of the cleaning surface from contact with the surface to be cleaned. Upon rotation of the mop body, the side surfaces can be placed into contact with the surface to be cleaned in order to pickup dirt, hair, lint, or other debris captured by the portion of the mop body contacting the surface to be cleaned. Further, in some embodiments the lowermost contact provides essentially a single point of contact with the surface to be cleaned to enable the mop body to easily remove debris from corners. The disclosed mop construction greatly enhances the total amount of surface area of the cleaning surface that is effectively used for cleaning.

In one embodiment, a mop body comprises a working surface having a first cleaning side and a second cleaning side, opposite the first cleaning side, a first most lateral point located at the first cleaning side, a second most lateral point located at the second cleaning side, a lowermost contact portion positioned between the first cleaning side and the second cleaning side. The lowermost contact portion includes a lowermost contact point. The mop body has a Total Linear Width Distance from the first most lateral point to the second most lateral point, a First Linear Height Distance from the lowermost contact point to the first most lateral point, and a Second Linear Height Distance from the lowermost contact point to the second most lateral point. The First Linear Height Distance is at least one third the Total Linear Width Distance and wherein the Second Linear Height Distance is at least one third the Total Linear Width Distance.

In one embodiment, a mop body comprises a convexly curved working surface with a constant radius of curvature extending between 100 and 200 degrees.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1:
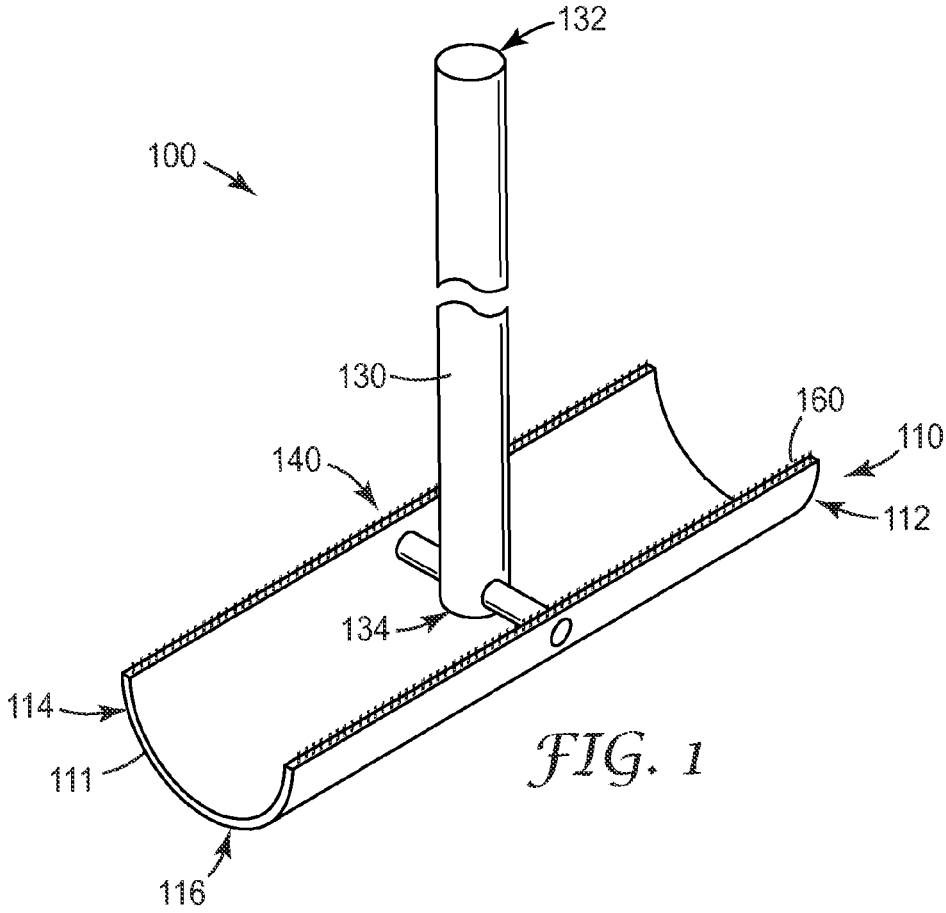
FIG. 1 is a perspective view of a first embodiment of a mop body.
Figure 2:
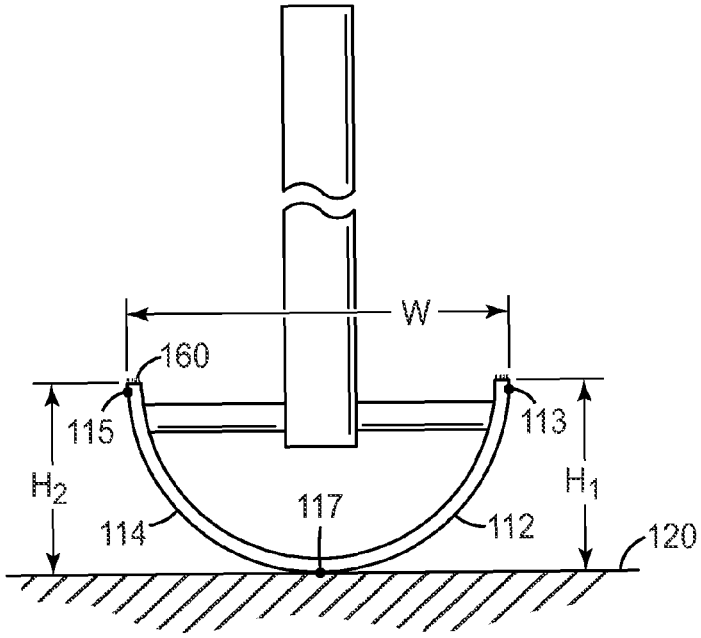
FIG. 2 is a side view of the mop body of FIG. 1.
Figure 3:
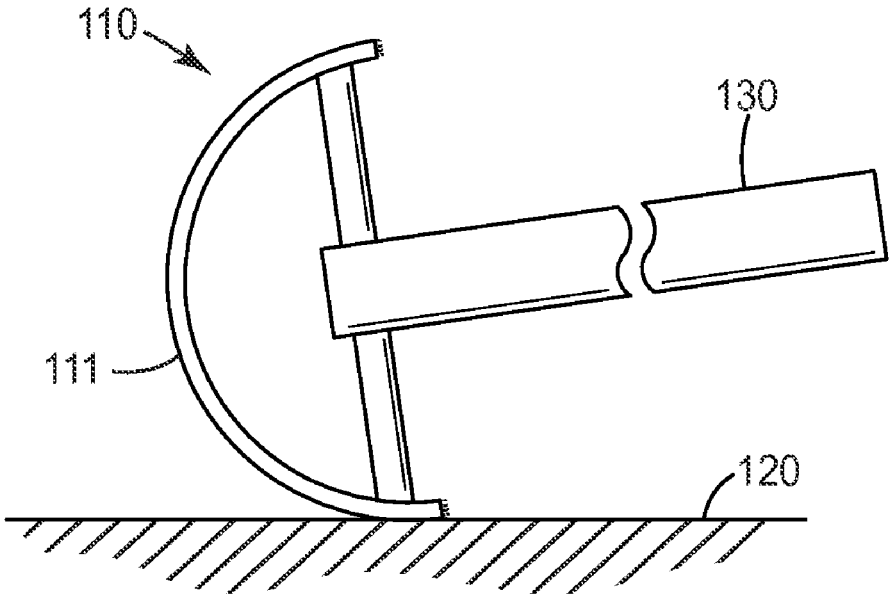
FIG. 3 is a side view of the mop body of FIG. 1 rotated with respect to the surface being cleaned.

FIG. 1 is a perspective view of a first embodiment of a cleaning tool 100 having a mop body 110. FIG. 2 is a side view of the mop body 110 of FIG. 1. FIG. 3 is a side view of the mop body 110 of FIG. 1 rotated during use with respect to the surface being cleaned 120.

The mop body 110 includes a working surface 111 that is the surface that makes contact with the surface to be cleaned 120. Generally, the mop body 110 is longitudinally extending and has a first cleaning side 112 and a second cleaning side 114, opposite the first cleaning side 112. Each of the first cleaning side 112 and second cleaning side 114 provides a suitable surface for making contact with the surface to be cleaned. Positioned on the working surface 111 between the first cleaning side 112 and second cleaning side 114 is the lowermost contact portion 116. The lowermost contact portion 116 is a section of the mop body 110 that generally makes contact with the surface to be cleaned 120. Generally, the lowermost contact portion extends between −20 degrees to +20 degrees of actuation of the mop body 110, where FIG. 2 is representative of 0 degrees of rotation. The lowermost contact portion 116 includes a lowermost contact point 117 that is the point on the mop body 110 that is the lowest extending point.

Figure 6:
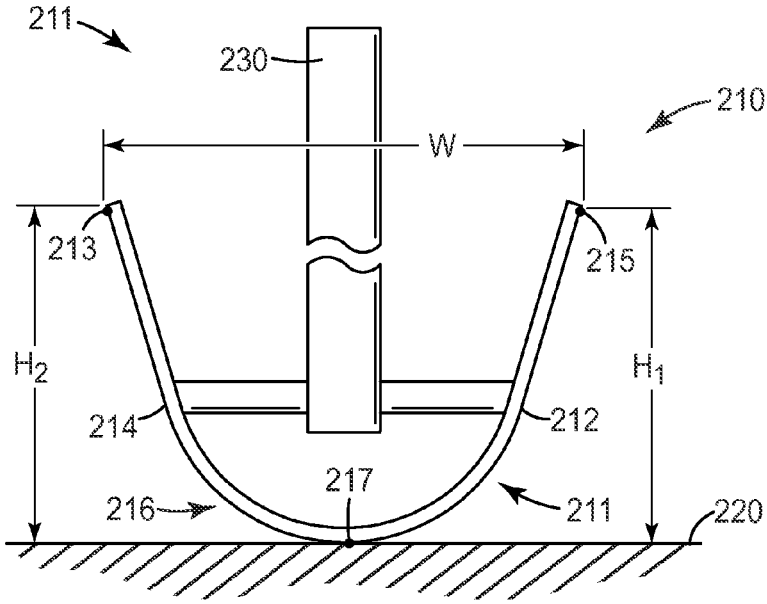
FIG. 6 is a side view of a second embodiment of a mop body.
Figure 7:
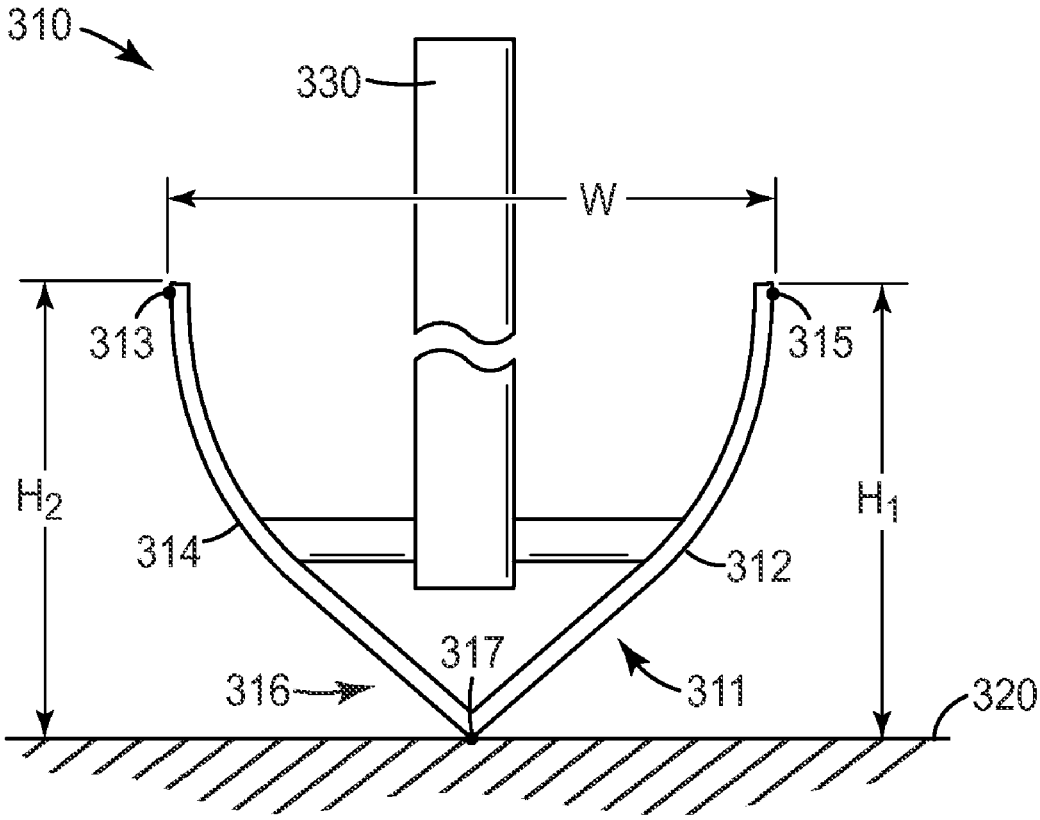
FIG. 7 is a side view of a third embodiment of a mop body.

In one embodiment, the lowermost contact portion 116 provides a single point of contact with the surface to be cleaned 120 such as shown in FIGS. 1, 6, and 7. It is understood that this lowermost contact portion 116 may be a single point as seen on a side view like shown in FIG. 2, but that typically this lowermost contact portion 116 would be a line extending along the length of the mop providing a lowermost contact portion 116. In the embodiment of FIGS. 1 and 6, the lowermost contact portion 116 is a convex curve such that a single point 117 (as seen in a side view, FIG. 2) along the curve makes contact with the surface to be cleaned 120. In the embodiment of FIG. 7, the lowermost contact portion 116 is two planar surfaces that meet at an angle such that a single point 317 (as seen in a side view, FIG. 7) at the angle is making contact with the surface to be cleaned 120.

Extending from the lowermost contact portion 116 is the first cleaning side 112 and second cleaning side 114. The first cleaning side 112 and second cleaning side 114 extend from the lowermost contact portion 116 in a direction away from the surface being cleaned. As shown, the first and second cleaning sides 112, 114 greatly recess from the lowermost contact portion 116 and therefore from the surface to be cleaned 120. As shown in the embodiment of FIGS. 1 and 2, the first cleaning sides 112, 114 are convexly curved surfaces. In the embodiment shown in FIGS. 1 and 2, the entire mop body 110 is a convexly curved surface having a constant radius of curvature, where the curved surface is approximately 180 degrees. It is understood, that a similar construction as shown in FIG. 2 can be used where the convexly curved surface extends anywhere from 100 to 200 degrees. In one embodiment where the entire mop body 110 is a constant radius of curvature, the radius of curvature is greater than 7 cm. In one embodiment where the entire mop body 110 is a constant radius of curvature, the radius of curvature is less than 18 cm.

Located at the first cleaning side 112 is a first most lateral point 113 and at the second cleaning side 114 is a second most lateral point 115. The first most lateral point 113 and second most lateral point 115 are the most outwardly extending points at the first and second side, respectively, relative to the lowermost contact point 117.

Overall the mop body 110 has a "Total Linear Width Distance" represented as "W" on FIG. 2, which is defined as the linear distance between the first most lateral point 113 and the second most lateral point 115, wherein the line connecting these two points is parallel to an intended surface to be cleaned while the mop is oriented at zero degrees of rotation, such as shown in FIG. 2. Therefore, because the mop body 110 of FIG. 2 is symmetrical, a straight line connecting the first most lateral point 113 and second most lateral point 115 represents the Total Linear Width Distance.

The mop body 110 has a "First Linear Height Distance" represented as "$H_1$" on FIG. 2, which is defined as the linear distance between the first most lateral point 113 and the lowermost contact point 117, wherein the line is normal to an intended surface to be cleaned while the mop is oriented at zero degrees of rotation, such as shown in FIG. 2. Therefore, the First Linear Height Distance is not the line connecting the first most lateral point 113 and lowermost contact point 117, but instead a line that represents the extent to which the first side 112 is recessed from the lowermost contact point 117.

The mop body 110 has a "Second Linear Height Distance" represented as "$H_2$" on FIG. 2, which is defined as the linear distance between the second most lateral point 115 and the lowermost contact point 117, wherein the line is normal to an intended surface to be cleaned while the mop is oriented at zero degrees of rotation, such as shown in FIG. 2. Therefore, the Second Linear Height Distance is not the line connecting the second most lateral point 115 and lowermost contact point 117, but instead a line that represents the extent to which the second side 114 is recessed from the lowermost contact point 117.

The first and second sides 112, 114 are significantly recessed from the lowermost contact 116. In one embodiment, the First Linear Height Distance is at least one third the Total Linear Width Distance. In one embodiment, the Second Linear Height Distance is at least one third the Total Linear Width Distance. In another embodiment, the First Linear Height Distance is at least half the Total Linear Width Distance. In another embodiment, the Second Linear Height Distance is at least half the Total Linear Width Distance. The First Liner Height Distance may be equal to the Second Linear Height Distance such as shown in FIG. 2. However, it is understood that the mop body may be asymmetrical such that the First Linear Height Distance may be greater than or less than the Second Linear Height Distance.

The mop body 110 can be constructed from a variety of materials. Typically, the mop body 110 is made of a plastic material. However, foams or other semi-soft materials may be placed over all or portions of the working surface 111 of the mop body 110. In particular, in one embodiment the lowermost contact 116 may include a foam while the side surfaces do not. Such an arrangement of materials may be particularly beneficial for an embodiment such as shown in FIG. 7 where the shape and configuration of the lowermost contact portion varies from the side surfaces. The foam provides a compressible material for maintaining constant contact with the surface to be cleaned at the lowermost contact portion. The foam could also be absorbent to pick up or deliver liquid to the surface being cleaned.

In one embodiment, the mop body 110 includes an overall height that is at least 2.5 cm, an overall width that is at least 7.5 cm, and an overall length that is at least 12 cm.

Figure 4:
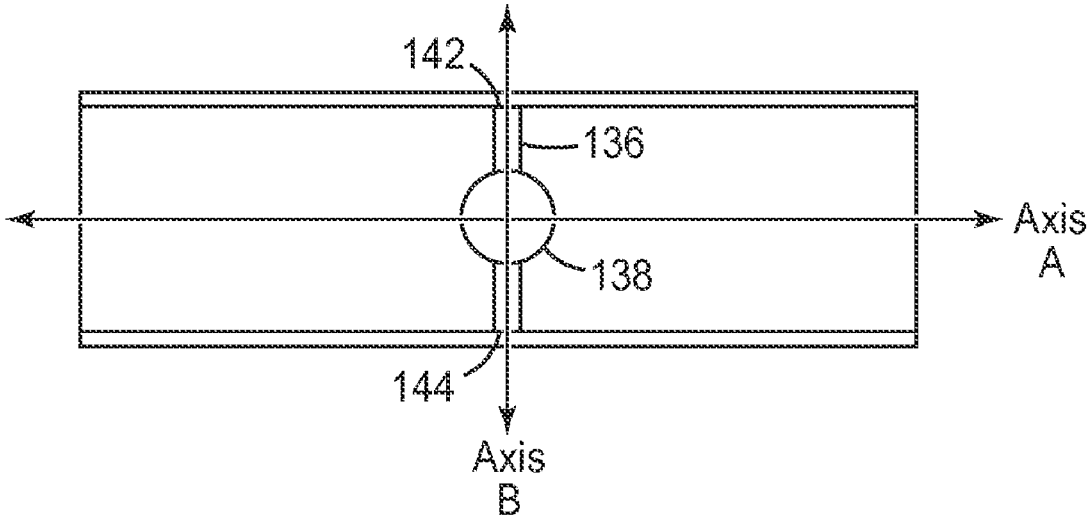
FIG. 4 is a top view of a first embodiment of a connector on a mop body.

Attached to the mop body 110 is a handle 130. The handle 130 includes a free end 132 and connecting end 134 that is attached to a connector 140 on the mop body 110. FIG. 4 is a top view of a first embodiment of the connector 140 and handle 130 on the mop body 110. At the connecting end 134 of the handle 130 is a first pivot connection 136 and second pivot connection 138, opposite the first pivot connection 136. At the connector 140 is a first receiving hub 142 and second receiving hub 144. The first receiving hub 142 pivotally receives the first pivot connection 136. The second receiving hub 144 pivotally receives the second pivot connection 138. In this embodiment, the attachment between the handle 130 and the connector 140 allow for pivotal rotation of the handle 130 only along Axis A and does not allow for pivotal rotation of the handle 130 along Axis B. Therefore, movement of the handle 130 along Axis B causes rotation of the working surface of the mop body 110 moving the first or second side 112, 114 into contact with the surface to be cleaned 120.

In the embodiments shown in the figures, the mop body 110 is open on the ends. In other words, for example, the embodiment shown in FIG. 1-5 is a half-pipe. Therefore, because the handle 130 can rotate along Axis A, which is parallel to a length of the mop body, the handle 130 is able to rest within the mop body such that the handle is entirely parallel with the surface to be cleaned. Therefore, the cleaning tool 100 can be stored in a very compact configuration and can easily clean hard to reach areas such as under furniture, etc. A snap-fit connector or other type of mechanical or adhesive connection could be provided on the mop body 110 to lock the handle 130 to the mop body 110 for storage.

Figure 5:
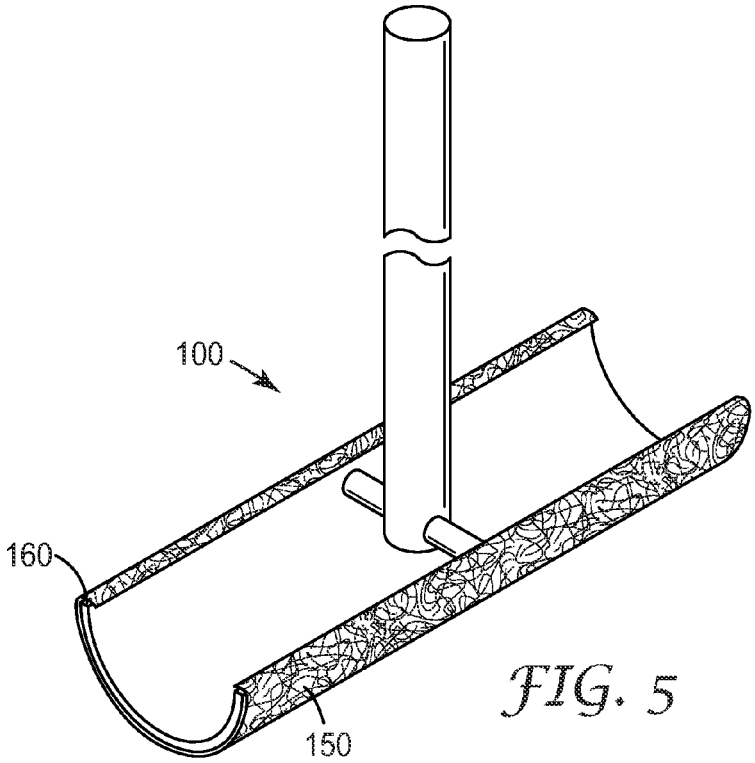
FIG. 5 is a perspective view of a mop body, such as shown in FIG. 1 with an attached cleaning sheet.

In one embodiment, applied to the working surface 111 of the mop body 110 is a cleaning sheet 150. FIG. 5 is a perspective view of a mop body, such as shown in FIG. 1 with an attached cleaning sheet 150. An attachment mechanism 160 is used to secure the cleaning sheet 150 to the working surface 111 of the mop body 110. The attachment mechanism 160 may be a hook system (as shown in FIG. 1) secured to the mop body 110 that can interact with a loop of the cleaning sheet, a mechanical fastener such as pinch points to press the cleaning sheet 150 into engagement with the mop body 110, adhesive on the mop body 110 to secure with cleaning sheet 150, or other known attachment mechanisms. The attachment mechanism 160 shown is included on a top portion of the mop body 110. It is understood that the attachment mechanism 160 may be located at other various locations of the mop body 110 such as on the side surfaces or inside the mop body (opposite the side surfaces).

The cleaning sheet 150 may be any kind of a cleaning sheet suitable for cleaning, scrubbing, wiping, or polishing a surface. The cleaning sheet 150 may be a woven, knitted, or nonwoven material that is reusable, semi-reusable or disposable. One particularly suitable cleaning sheet 150 is a nonwoven material that includes an adhesive on the cleaning sheet 150 to greatly enhance the ability of the cleaning sheet 150 to capture and retain small and large particles. US2007/0136967 titled "Adhesive Wipe," US2003/0171051 titled "A Wipe," US2007/0202768 titled "Cleaning Wipe with Variable Loft Working Surface," and U.S. application Ser. No. 12/194,777 filed Aug. 20, 2008 titled "Lofty, Tackified Nonwoven Sheet and Method of Making" the disclosures of which are all herein incorporation by reference.

To use the cleaning tool 100 the cleaning sheet 150 is applied to the working surface 111 of the mop body 110. By pushing the handle 130, the user can slide the working surface 111 over the surface to be cleaned 120. To maximize the amount of surface area of the cleaning sheet 150 available for picking up dirt, lint, hair, or other debris, the user can actuate the handle 130 attached to the mop body 110 to bring either the first cleaning side 112 or second cleaning side 114 into contact with the surface to be cleaned 120. The user can twist the handle such that either the first cleaning side 112 or second cleaning side 114 is the leading surface during a pushing or pulling movement. Also, the user could slide the working surface 111 over a surface to be cleaned 120 and when a large amount of dirt, lint, hair, or other debris has collected into a pile on the surface being cleaned 120, then the user can actuate either the first cleaning side 112 or second cleaning side 114 into contact with the pile of material to pick up and retain the material on the cleaning sheet 150.

FIG. 6 is a side view of a second embodiment of a mop body 210. The mop body 210 includes a working surface 211 that makes contact with the surface to be cleaned 220. The mop body 210 is longitudinally extending and has a first cleaning side 212 and a second cleaning side 214, opposite the first cleaning side 212. Positioned on the working surface 211 between the first cleaning side 212 and second cleaning side 214 is the lowermost contact portion 216. The lowermost contact portion 216 includes a lowermost contact point 217 that is the point on the mop body 210 that is the lowest extending point.

In one embodiment, the lowermost contact portion 216 provides single point of contact with the surface to be cleaned 220. It is understood that this lowermost contact portion 216 may be a single point as seen on a side view like shown in FIG. 6, but that typically this lowermost contact portion 216 is a line extending along the length of the mop providing a lowermost contact portion 216. The lowermost contact portion 216 is a convex curve such that a single point (as seen in a side view, FIG. 6) along the curve makes contact with the surface to be cleaned 220.

Extending from the lowermost contact portion 216 is the first cleaning side 212 and second cleaning side 214. The first and second cleaning sides 212, 214 greatly recess from the lowermost contact portion 216 and therefore from the surface to be cleaned 220. The first cleaning sides 212, 214 are straight and planar surfaces. The planar side surfaces allow for a planar surface to selectively come into contact with the surface being cleaned. Located at the first cleaning side 212 is a first most lateral point 213 and at the second cleaning side 214 is a second most lateral point 215.

In this embodiment, the "Total Linear Width Distance" is represented as "W." The "First Linear Height Distance" is represented as "$H_1$" and the "Second Linear Height Distance" is represented as "$H_2$." In this embodiment, the First Linear Height Distance is at least half the Total Linear Width Distance. In particular, in this embodiment, the First Linear Height Distance is approximately equal to ¾ the Total Linear Width Distance. In this embodiment, the Second Linear Height Distance is at least half the Total Linear Width Distance. In particular, in this embodiment, the Second Linear Height Distance is approximately equal to ¾ the Total Linear Width Distance. In this embodiment, the First Liner Height Distance is equal to the Second Linear Height Distance.

FIG. 7 is a side view of a third embodiment of a mop body 330. The mop body 310 includes a working surface 311 that makes contact with the surface to be cleaned 320. Generally, the mop body 310 is longitudinally extending and has a first cleaning side 312 and a second cleaning side 314, opposite the first cleaning side 312. Positioned on the working surface 311 between the first cleaning side 312 and second cleaning side 314 is the lowermost contact portion 316. The lowermost contact portion 316 includes a lowermost contact point 317 that is the point on the mop body 310 that is the lowest extending point.

The lowermost contact portion 316 provides single point of contact with the surface to be cleaned 320. It is understood that this lowermost contact portion 316 may be a single point as seen on a side view like shown in FIG. 7, but that the lowermost contact portion 316 would be a line extending along the length of the mop body providing a lowermost contact portion 316. The lowermost contact portion 316 is two planar surfaces that meet at an angle such that a single point at the angle is making contact with the surface to be cleaned 320. Although it is clear that a finite point is included at the lowermost contact portion 316, it has been found that this construction creates enough contact with the surface to be cleaned to gather and collect debris for which the side surface can then come into contact with to pick up the debris. In one embodiment, the lowermost contact portion 116 is a solid, triangular material, such as foam, applied to the mop body 110. A foam material provides a resilient surface that ensures constant contact with the surface being cleaned.

Extending from the lowermost contact portion 316 is the first cleaning side 312 and second cleaning side 314. The first and second cleaning sides 312, 314 greatly recess from the lowermost contact portion 316 and therefore from the surface to be cleaned 320. The first cleaning sides 312, 314 are convexly curved surfaces. Located at the first cleaning side 312 is a first most lateral point 313 and at the second cleaning side 114 is a second most lateral point 115.

The "Total Linear Width Distance" is represented as "W" on FIG. 7. The "First Linear Height Distance" is represented as "$H_1$" and the "Second Linear Height Distance" is represented as "$H_2$" on FIG. 7. In this embodiment, the First Linear Height Distance is at least half the Total Linear Width Distance. In particular, in this embodiment, the First Linear Height Distance is approximately equal to ¾ the Total Linear Width Distance. In this embodiment, the Second Linear Height Distance is at least half the Total Linear Width Distance. In particular, in this embodiment, the Second Linear Height Distance is approximately equal to ¾ the Total Linear Width Distance. In this embodiment, the First Liner Height Distance is equal to the Second Linear Height Distance such as shown in FIG. 2. However, it is understood that the mop body may be asymmetrical such that the First Linear Height Distance may be greater than or less than the Second Linear Height Distance.

It is understood that a variety of combinations of convexly curved, concavely curved, planar, undulating at the first cleaning side, second cleaning side and lowermost contact portion may be used. The greatly recessed side surfaces allow for a large amount of the mop body surface area to be recessed and removed from the surface to be cleaned. However, actuation of the mop body allows for selective engagement of the side surfaces with portions of the surface to be cleaned. Therefore, essentially the entire cleaning surface can be loaded with dirt, dust, lint, or other debris to maximize the usable surface area of the cleaning sheet.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A cleaning tool comprising:

a mop body including:

a working surface having a first cleaning side and a second cleaning side, opposite the first cleaning side;

a first most lateral point located at the first cleaning side;

a second most lateral point located at the second cleaning side;

a lowermost contact portion positioned between the first cleaning side and the second cleaning side, wherein the lowermost contact portion includes a lowermost contact point;

wherein the mop body has a Total Linear Width Distance from the first most lateral point to the second most lateral point, a First Linear Height Distance from the lowermost contact point to the first most lateral point, and a Second Linear Height Distance from the lowermost contact point to the second most lateral point;

wherein the First Linear Height Distance is at least one third the Total Linear Width Distance and wherein the Second Linear Height Distance is at least one third the Total Linear Width Distance; and a handle that is pivotable relative to the mop body about an axis that intersects the first and second cleaning sides, and only along a length of the mop body.

2. The cleaning tool of claim 1, wherein the lowermost contact portion is a convexly curved surface.

3. The cleaning tool of claim 1, wherein the lowermost contact portion forms an angle.

4. The cleaning tool of claim 1, wherein the lowermost contact portion extends −20 degrees to +20 degrees of actuation of the mop body.

5. The cleaning tool of claim 1, wherein a first side is planar or convexly curved.

6. The cleaning tool of claim 1, wherein the second side is planar or convexly curved.

7. The cleaning tool of claim 1, further comprising a cleaning sheet applied over the mop body.

8. The cleaning tool of claim 1, comprising a constant single radius of curvature extending from the first lateral point to the second lateral point.

9. The cleaning tool of claim 1, wherein the First Linear Height Distance is at least one half the Total Linear Width Distance.

10. The cleaning tool of claim 1, wherein the Second Linear Height Distance is at least one half the Total Linear Width Distance.

11. The cleaning tool of claim 1, wherein the First Linear Height Distance is approximately equal to three fourths the Total Linear Width Distance, and further wherein the Second Linear Height Distance is approximately equal to three fourths the Total Linear Width Distance.

12. A mop body comprising:

a convexly curved working surface having a first cleaning side and a second cleaning side opposite the first cleaning side, the convexly curved working surface extending continuously between, and terminating at, opposing terminal ends and having a constant radius of curvature extending between 100 and 200 degrees;

a first most lateral point located at the first cleaning side;

a second most lateral point located at the second cleaning side;

a lowermost contact portion positioned between the first cleaning side and the second cleaning side, wherein the lowermost contact portion includes a lowermost contact point;

wherein the mop body has a Total Linear Width Distance from the first most lateral point to the second most lateral point, a First Linear Height Distance from the lowermost contact point to the first most lateral point, and a Second Linear Height Distance from the lowermost contact point to the second most lateral point;

wherein the First Linear Height Distance is at least on third the Total Linear Width Distance and wherein the Second Linear Height Distance is at least on third the Total Linear Width Distance.

13. The mop body of claim 12, further comprising a cleaning sheet applied over the mop body.

14. The mop body of claim 12, wherein the First Linear Height Distance and the Second Linear Height Distance are each at least one half the Total Linear Width Distance.

* * * * *

UNITED STATES PATENT AND TRADEMARK OFFICE

CERTIFICATE OF CORRECTION

PATENT NO. : 8,347,447 B2
APPLICATION NO. : 12/615464
DATED : January 8, 2013
INVENTOR(S) : Shaelyn DeAnn Benson It is certified that error appears in the above-identified patent and that said Letters Patent is hereby corrected as shown below:

Column 8

Line 44 (Approx.) In Claim 12, delete "on" and insert -- one --, therefor.

Line 46 (Approx.) In Claim 12, delete "on" and insert -- one --, therefor.

Signed and Sealed this
Second Day of April, 2013

Teresa Stanek Rea

Teresa Stanek Rea
*Acting Director of the United States Patent and Trademark Office*